US007434342B1

(12) United States Patent
Dieden et al.

(10) Patent No.: US 7,434,342 B1
(45) Date of Patent: Oct. 14, 2008

(54) BROCHURE DISPLAY DEVICE WITH DIRECTION INDICATOR

(76) Inventors: Andrew L Dieden, 840 Spring Dr., Mill Valley, CA (US) 94941; Z. Jamal Noorzoy, 1081 San Carlos Rd., Pebble Beach, CA (US) 93953

( * ) Notice: Subject to any disclaimer, the term of this patent is extended or adjusted under 35 U.S.C. 154(b) by 0 days.

(21) Appl. No.: 11/726,983

(22) Filed: Mar. 23, 2007

(51) Int. Cl.
*G09F 3/18* (2006.01)

(52) U.S. Cl. ..... 40/654.01; 40/661; D19/90; 33/354

(58) Field of Classification Search ..... 40/649, 40/654.01, 661, 341, 737, 725; D19/90; 33/354
See application file for complete search history.

(56) References Cited

U.S. PATENT DOCUMENTS

| | | | | | |
|---|---|---|---|---|---|
| 403,535 | A | | 5/1889 | Johnson | |
| 1,556,514 | A | * | 10/1925 | Feldman | 211/55 |
| 1,713,601 | A | | 5/1929 | Harris | |
| 1,739,801 | A | | 12/1929 | Pitts | |
| 1,925,844 | A | * | 9/1933 | Moll | 40/335 |
| D146,978 | S | | 6/1947 | Mack | |
| 2,701,089 | A | | 2/1955 | Fischer | |
| 3,023,519 | A | * | 3/1962 | Levin | 434/150 |
| 3,131,495 | A | * | 5/1964 | Stodola | 40/584 |
| 3,844,041 | A | * | 10/1974 | Wilson, Jr. | 33/1 SD |
| D251,466 | S | | 4/1979 | Ciminelli | |
| D261,902 | S | | 11/1981 | Oakley | |
| 4,372,052 | A | * | 2/1983 | Wakim | 33/349 |
| 4,460,095 | A | | 7/1984 | Kessler et al. | |
| D282,757 | S | | 2/1986 | Cohen | |
| D286,113 | S | | 10/1986 | Albery | |
| 4,696,109 | A | * | 9/1987 | Whaley, Jr. | 33/1 B |
| 4,844,264 | A | | 7/1989 | Deskiewicz | |
| 4,905,377 | A | * | 3/1990 | Martinez et al. | 33/333 |
| D318,436 | S | | 7/1991 | Cross | |
| D321,614 | S | | 11/1991 | Liptak | |
| 5,080,315 | A | | 1/1992 | Tucker-Schafer | |
| 5,085,328 | A | | 2/1992 | Evenson | |
| 5,150,813 | A | | 9/1992 | Harris et al. | |
| D330,474 | S | | 10/1992 | Liptak | |
| 5,165,554 | A | | 11/1992 | Schlesinger | |
| D334,676 | S | | 4/1993 | Liptak | |
| D361,349 | S | | 8/1995 | Brussing | |
| 5,513,746 | A | | 5/1996 | Anderson | |
| D373,698 | S | | 9/1996 | Farrell | |
| 5,575,396 | A | | 11/1996 | Smed | |
| 5,595,300 | A | | 1/1997 | Paik et al. | |
| 5,727,696 | A | | 3/1998 | Valiulis | |
| 5,803,275 | A | | 9/1998 | Schweitzer | |
| 5,850,957 | A | | 12/1998 | Morris | |
| 5,894,674 | A | * | 4/1999 | Feldman | 33/354 |
| 5,903,991 | A | | 5/1999 | Sasse | |

(Continued)

FOREIGN PATENT DOCUMENTS

| | | | | |
|---|---|---|---|---|
| CH | 678261 | A | * | 8/1991 |

*Primary Examiner*—Gary C Hoge
(74) *Attorney, Agent, or Firm*—Lukas IP Group; Rimas Lukas

(57) ABSTRACT

Promotional material display devices are provided. The display devices have a unique configuration that improves visual display and organization of promotional material including flyers and business cards. The display devices uniquely integrate a direction indicator with the display device providing an attractive dimension to and purpose for the flyer and business card holder in real estate applications.

35 Claims, 5 Drawing Sheets

U.S. PATENT DOCUMENTS

| | | | | |
|---|---|---|---|---|
| D423,824 | S | 5/2000 | Schlesinger | |
| 6,070,744 | A | 6/2000 | Levinson et al. | |
| D434,083 | S | 11/2000 | Vance | |
| 6,206,225 | B1 | 3/2001 | Fox | |
| D459,398 | S * | 6/2002 | Stravitz | D19/90 |
| 6,651,827 | B1 | 11/2003 | Eberwein et al. | |
| D485,312 | S | 1/2004 | Gaska et al. | |
| 6,705,473 | B1 | 3/2004 | Schlesinger | |
| 6,871,742 | B1 | 3/2005 | Paik | |
| 6,929,117 | B1 | 8/2005 | Cohen | |
| 6,968,959 | B1 | 11/2005 | Garvin | |
| 7,086,559 | B2 | 8/2006 | Poole | |
| 2006/0101690 | A1 | 5/2006 | Terbet | |

* cited by examiner

BROCHURE DISPLAY DEVICE WITH DIRECTION INDICATOR

FIELD

The present invention generally relates to devices for displaying advertising material. More particularly, but not exclusively, devices for displaying real estate brochures having a direction indicator are disclosed.

BACKGROUND

Standard real estate practices include certain routine procedures such as the preparation of a flyer or brochure that describes a home's characteristics. Information typically included on the flyer are the sale or lease price, the address, the number of rooms and bathrooms, unique features, pictures of the home and other specific information about the property. A quantity of these flyers is placed at the premise being offered for sale to enable clients viewing the property to have key information in a form that is concise and convenient take home with them to remember the property and its unique characteristics. Such flyers are utilized for both new and resale properties and are recognized as a standard marketing tool by real estate professionals. In addition to the promotional material pertaining to the property, it is common practice for listing agents to leave a number of their business cards for the use of anyone viewing the property.

The flyers and business cards are sometimes placed on a kitchen table or counter where they have to be constantly organized into neat stacks. Sometimes the business cards and flyers are organized and placed in a brochure display device that is typically made of plastic. Even when placed in a plastic display device, there still is a problem of keeping the displayed material attractively arranged at the point of use. For example, in many instances, the front wall of a display pocket terminates beneath the upper edges of the papers stored therein. As a result, the papers tend to curl over the front face and become damaged. Furthermore, as material is removed from the pocket, remaining papers in the pocket lack the support provided by a greater quantity of adjacent papers. Yet, with a large number of brochures, sometimes it is difficult to remove just a single copy. Similarly with business cards, as cards are removed, the remaining cards do not have additional support from adjacent cards to remain in a substantially upright orientation and as a result, cards sometimes flop forward obscuring the front side of the card from view. Business cards are sometimes equally difficult to separate and remove requiring greater finger accessibility.

In addition to the information provided on the flyers, visitors to an open house frequently like to know in what direction the house is oriented. Typically, this information is not printed on the flyer. Sometimes, the question is asked of the agent so that the potential buyer can better visualize the expected exposure to sunlight, for example, at a time different from when visiting the house. Also, many times visitors become disoriented after spending some time inside an unfamiliar house and would like to know where a certain direction lies. Furthermore, some visitors like to know other directional information such as in which direction is a certain landmark outside the house such as a downtown, ocean, airport or nearby street relative to the house. Cardinal compass directions are also important for visitors interested in feng shui applications for the home.

These problems exist not only in the home selling industry but in all kinds of advertising industries which need to stack display brochures, often of different sizes, or provide a direction information. It is an object of the present invention to provide a promotional material display which overcomes the shortcomings described above.

SUMMARY

According to one aspect of the invention, a promotional material display device is provided. The promotional material display device includes a first promotional material receiving portion configured to receive promotional material. A support is connected to the first promotional material receiving portion and configured to support the first promotional material receiving portion on a flat surface. The promotional material display device includes a direction indicator connected to the device. The direction indicator is configured to provide indication of at least one direction information.

According to another aspect of the invention, a promotional material display device is provided. The promotional material display device includes a back wall, a first sidewall and a second sidewall. The first sidewall is spaced apart from the second sidewall. The device includes a first front wall that is spaced apart from the back wall. The device further includes a first bottom. The back wall, the first and second sidewalls, the first front wall and the first bottom are configured to define a first cavity of a first promotional material receiving portion. The first cavity has an open top such that the first front wall is interconnected to the back wall by at least one or more of the first bottom, the first sidewall and the second sidewall. The first cavity is configured to receive promotional material. The device further includes a direction indicator connected to the device for indicating at least one direction information.

According to yet another aspect of the invention, a promotional material holder for display on a substantially flat surface is provided. The holder includes a back wall, a first sidewall and a second sidewall. The first sidewall is spaced apart from the second sidewall. A first front wall is also provided that is spaced apart from the back wall. The holder further includes a first bottom. The back wall, the first and second sidewalls, the first front wall and the first bottom are configured to define a first cavity of a first promotional material receiving portion. The first front wall is interconnected to the back wall by the first bottom, the first sidewall and the second sidewall. The first cavity has an open top and is configured to receive promotional material. A third sidewall and a fourth sidewall are also provided. The third sidewall is spaced apart from the fourth sidewall. The holder includes a second front wall that is spaced apart from the first front wall. A second bottom is provided. At least a portion of the first front wall, the third and fourth sidewalls, the second front wall and the second bottom are configured to define a second cavity of a second promotional material receiving portion. The second front wall is interconnected to the first front wall by the second bottom, the third sidewall and the fourth sidewall. The first cavity has an open top and is configured to receive promotional material. The holder further includes a base wall that is connected to the first promotional material receiving portion such that the base wall forms an acute angle with the back wall. The base wall being is configured to support the device on the flat surface. The holder further includes direction indicator for indicating at least one direction information connected to the device at the first front wall or the second front wall.

Other advantages will be apparent from the description that follows, including the drawings and claims.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Included in the drawings are the following figures.

DETAILED DESCRIPTION

Figure 1:
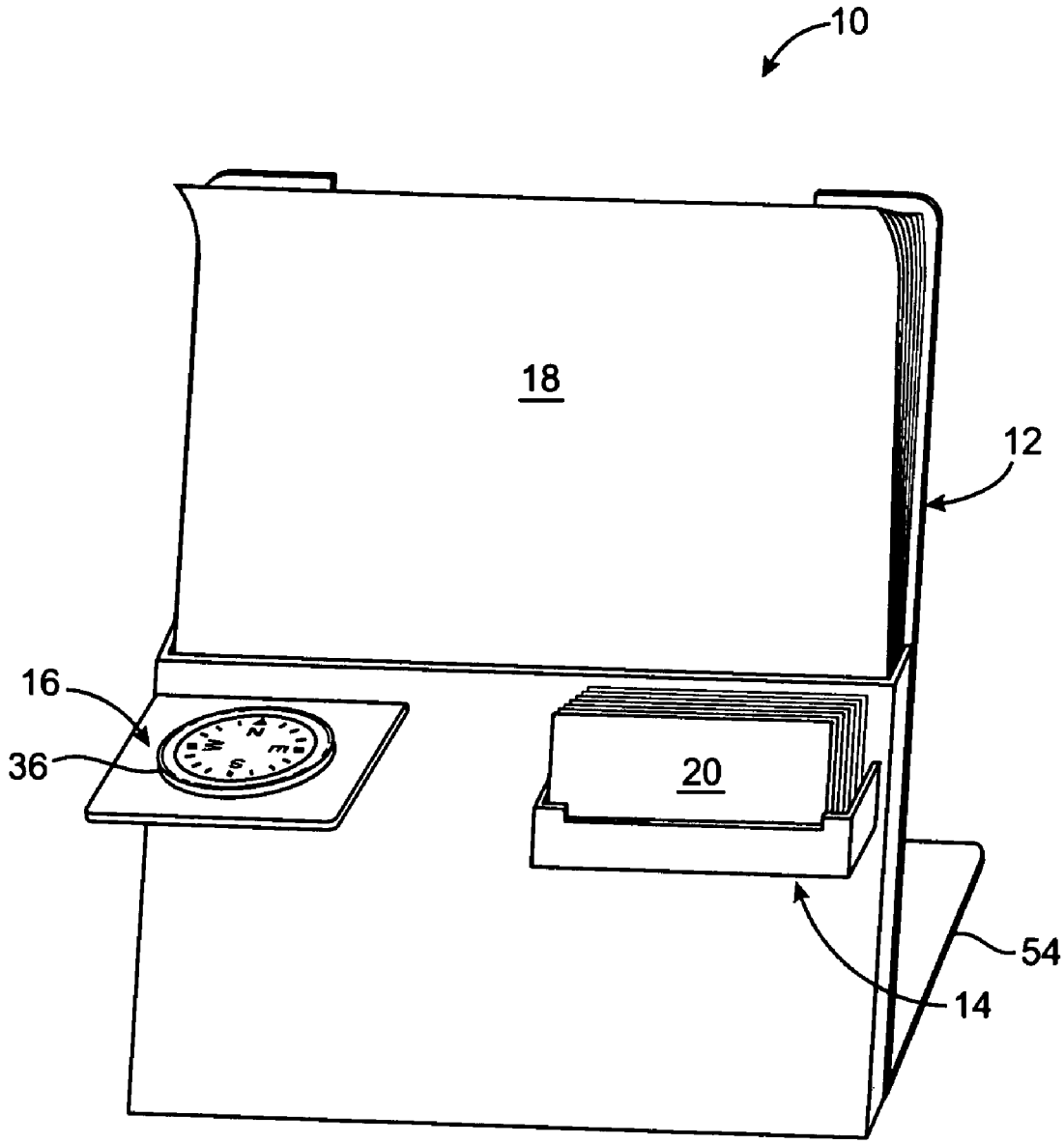
FIG. 1 is a perspective view of the promotional material display device with promotional material according to the present invention.

Before the subject devices, systems and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

The present invention will now be described in detail by way of the following description of exemplary embodiments and variations of the systems and methods of the present invention.

Referring now to FIGS. 1 through 7, there is shown a promotional material display device 10 comprising a first promotional material receiving portion 12, a second promotional material receiving portion 14, and a direction indicator 16. The second promotional material receiving portion 14 and direction indicator 16 are connected to the first promotional material receiving portion 12 as shown in the figures. The first promotional material receiving portion 12 is configured to receive promotional material 18 that is larger than the promotional material 20 that the second promotional material receiving portion 14 is configured to receive. In one variation, the first receiving portion 12 is configured to receive 8½ by 11 inches sized sheets of paper 18 and the second receiving portion 14 is configured to receive business cards 20. The direction indicator 16 is any information indicator. In one variation, the direction indicator 16 is a compass 36 which extends outwardly from the first receiving portion 14. The display 10 is preferably made of plastic; however, the invention is not so limited and the display can be made of any kind of suitable material known to one having ordinary skill in the art. In one variation, the display is made of transparent material but this is also not required and the display may be made of any opaque, translucent, semi-transparent, colored or any kind of material. The promotional material holder 10 is generally configured to be displayed on a substantially flat surface such as a table top and designed such that the first receiving portion 12 is angled with respect to the flat surface for ease of access to the promotional material 18, 20.

Figure 2:
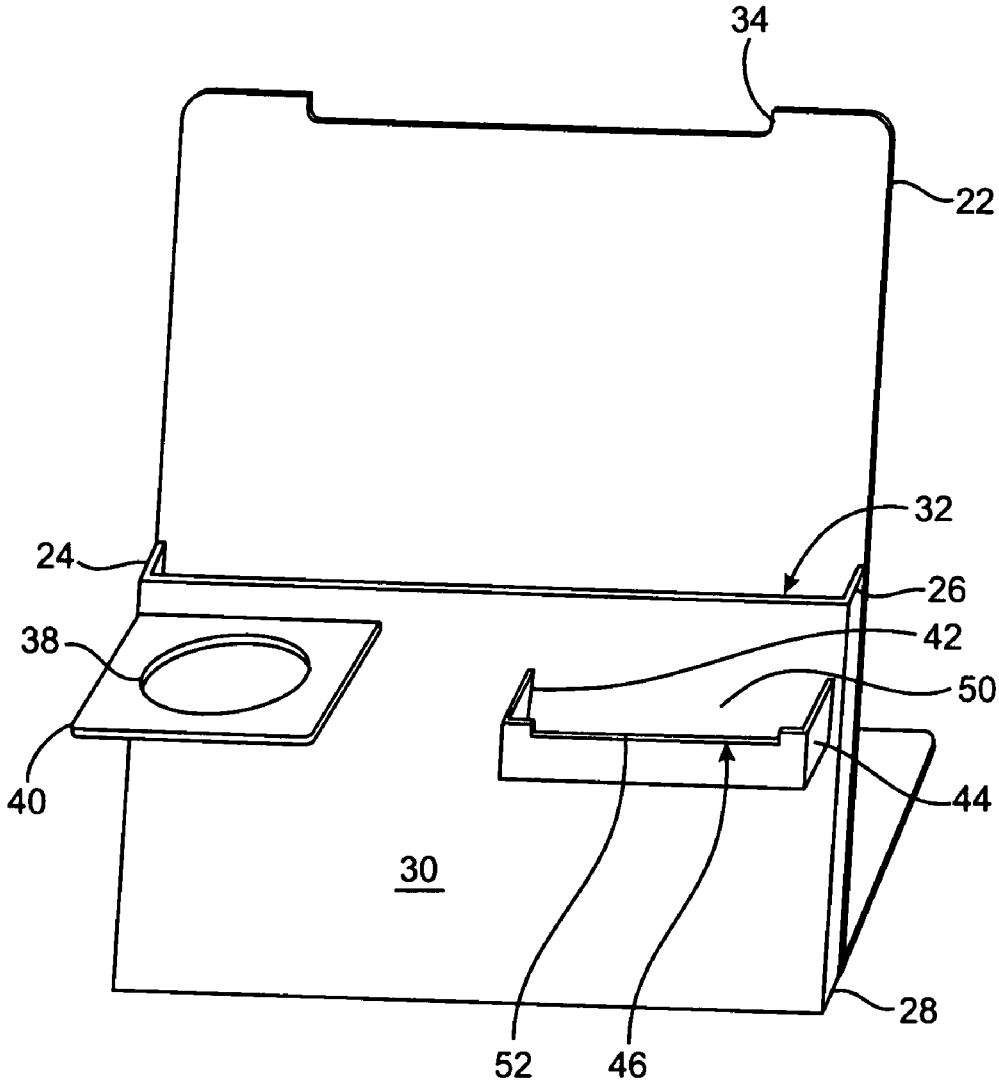
FIG. 2 is a perspective view of the promotional material display device according to the present invention without the direction indicator.

With particular reference to FIG. 2 and general reference to FIGS. 1 through 7, the flyer holder 10 includes a back wall 22, a first sidewall 24 and a second sidewall 26. The first sidewall 24 is spaced apart from the second sidewall 26 and, in one variation, the first sidewall 24 is substantially parallel to the second sidewall 26. The flyer display 10 further includes a first front wall 30 that is spaced apart from the back wall 22 and, in one variation, the first front wall 30 is substantially parallel to the back wall 22. A first bottom 28 is also provided. The back wall 22, the first and second sidewalls 24, 26, the first front wall 30 and the first bottom 28 are configured to define a first cavity 32 of the first promotional material receiving portion 12. The first front wall 30 is interconnected to the back wall 22 by at least one or more of the first bottom 28, the first sidewall 24 and the second sidewall 26. In one variation of the invention, the first front wall 30 is interconnected to the back wall 22 by all three of the first bottom 28, the first sidewall 24 and the second sidewall 26. The first cavity 32 has an open top through which promotional material 18 is inserted into the cavity 32.

Figure 5:
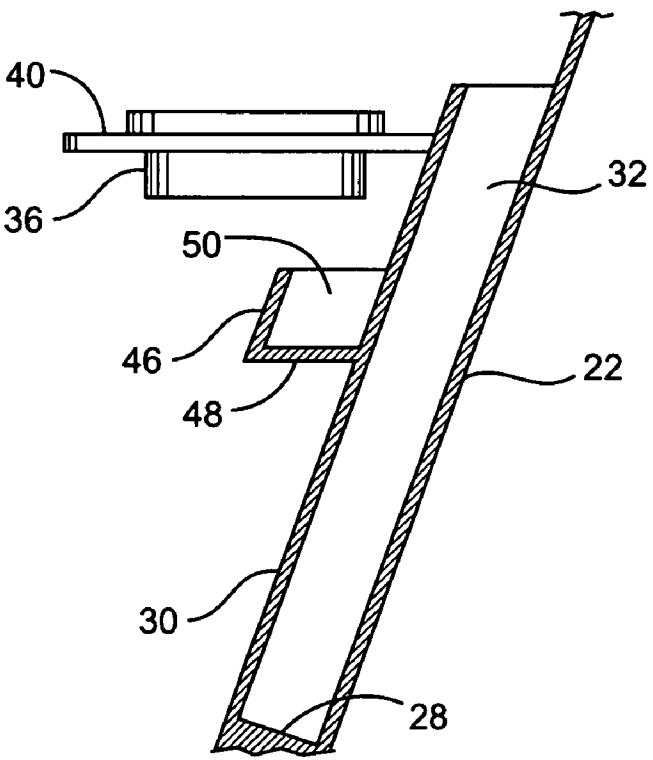
FIG. 5 is a partial side cross-sectional view of the promotional material display device according to the present invention.
Figure 4:
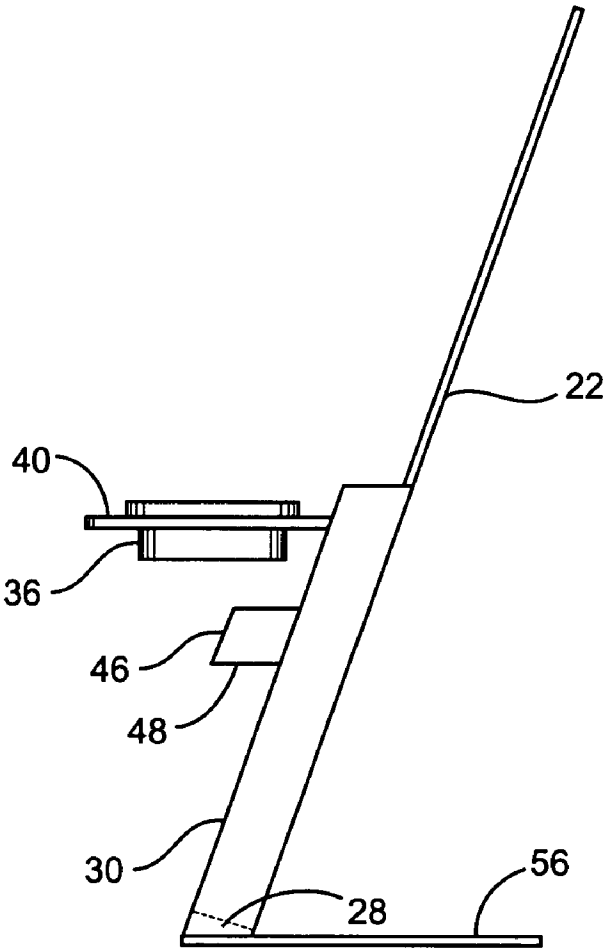
FIG. 4 is a side view of the promotional material display device according to the present invention.

With particular reference to FIGS. 4 and 5, the first bottom 28 is oriented substantially perpendicular to the back wall 22. In general, the first bottom 28 slopes upwardly from the back wall 22 to the first front wall 30. This slope advantageously keeps promotional material 18 propped up nicely inside the first cavity 32. As pages of promotional material 18 are removed from the first cavity 32, remaining pages slide down the slope of the first bottom 28 keeping the stack of promotional material neatly stacked.

Figure 3:
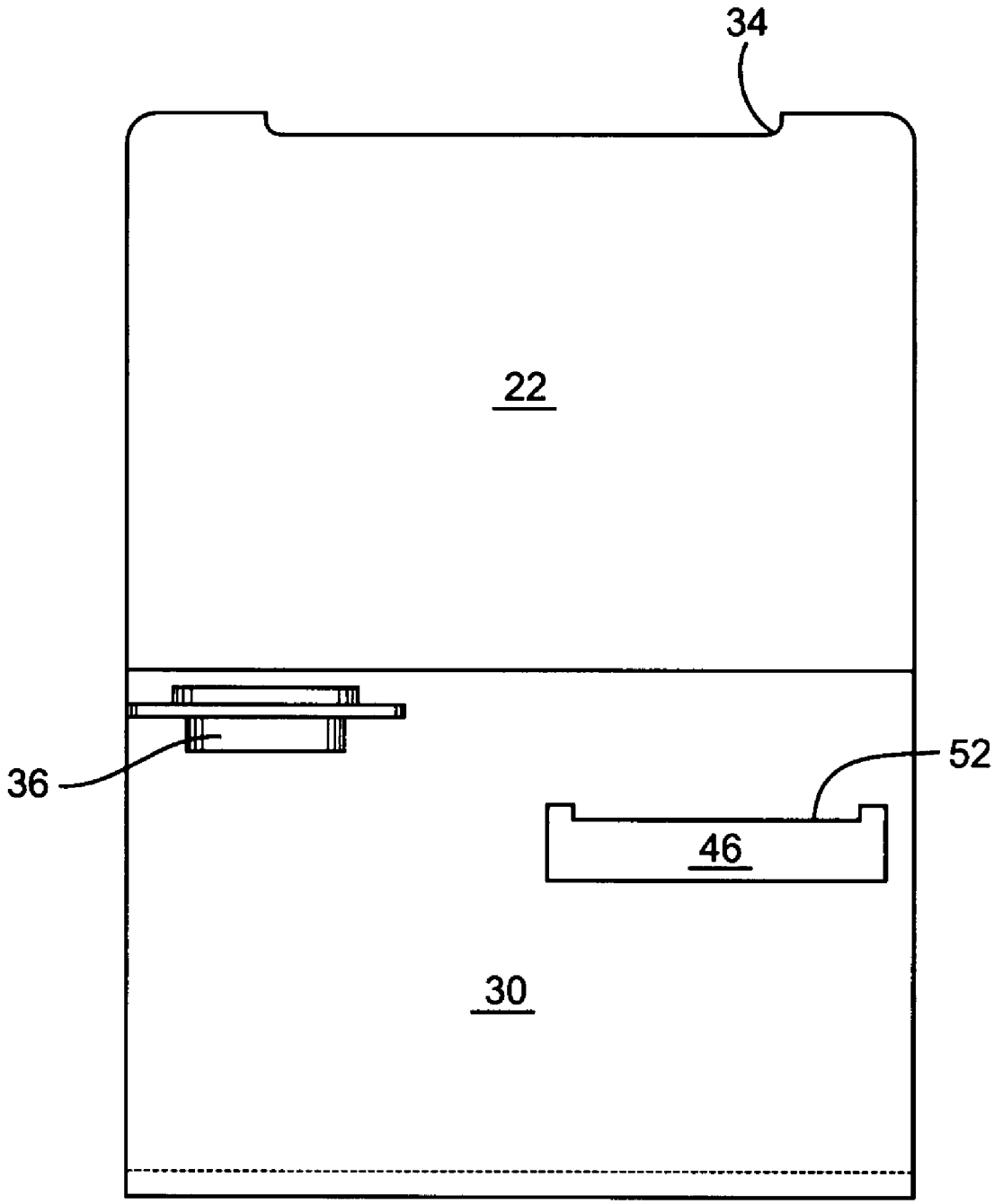
FIG. 3 is a front view of the promotional material display device according to the present invention.

As seen in the figures, the first front wall 30 is shorter than the back wall 22. The first front wall 30 typically rises a quarter to two-thirds of the way up from the first bottom 28 with respect to the back wall 22 such that the promotional material 18 in the first receiving portion 12 is not covered by the first front wall 30. This is particularly advantageous when non-transparent material is used to construct the first front wall 30. If transparent material is employed for the first front wall 30, the first front wall 30 can be designed to rise higher with respect to the back wall 22. As seen in FIG. 2 and FIG. 3, the top edge of the back wall 22 includes a scalloped or relieved portion 34 to facilitate removal of promotional material from the first cavity 32.

In one variation, the direction indicator 16 provides the direction of at least one cardinal compass direction such as "north," "south," "east" and "west" with respect to the display device 10. In one variation, the direction indicator 16 is a magnetic compass 36 that is inserted through an opening 38 in a flange 40 that extends outwardly from the first front wall 30 as shown in FIG. 2. In one variation, the compass 36 is removable and rotatable with respect to the display 10. Also, the direction indicator 16 is connected at any functional location on the display 10. Preferably, the direction indicator 16 is connected to the front wall 30 and is substantially horizontal to the flat surface on which the display 10 is placed as shown in FIGS. 4 and 5 to provide easy viewing of the direction information. Furthermore, if a compass is employed as the direction indicator, it need not be a functioning magnetic compass but may be any kind of compass including a representational compass. An example of a representational compass is an element disposed within the opening 38 of the flange 40 with an arrow pointing to the direction "north" for example. The element being rotated by the user with in the opening 38 of the flange 40 to match a true compass direction. Any representational form of compass may be employed with the invention.

Furthermore, the direction indicator is not limited to showing the cardinal compass directions, but any direction information can be indicated by the direction indicator. One example of a direction information is a sunny or southern exposure direction of the relevant structure that is indicated by the color yellow or graphic depiction of a sun for example. Another example of a direction information is a dark side and the color blue or black or a graphic depiction of a moon to indicate a dark side on a dial or other formatted structure of the direction indicator. Other examples of direction informations are the direction of the nearest city, largest city, downtown, the ocean, lake, grocery store, water feature, street, airport, sitting direction and facing direction of the home. Any direction information conveyed via the direction indicator is within the scope of the present invention and, of course, any distance or other information associated with a direction information may also be included on the direction indicator.

In one variation of the invention, there is no second promotional material receiving portion 14. In another variation as shown in FIGS. 1 through 7 and with particular reference to FIGS. 2, and 4-7, the second promotional material receiving portion 14 of the display device 10 includes a third sidewall 42 and a fourth sidewall 44. The third sidewall 42 is spaced apart from the fourth sidewall 44 and in one variation the third sidewall 42 is substantially parallel to the fourth sidewall 44. The second promotional material receiving portion 14 further includes a second bottom 48 and a second front wall 46 that is spaced apart from the first front wall 30. The first front wall 30, the third and fourth sidewalls 42, 44, the second front wall 46 and the second bottom 48 are configured to define a second cavity 50 of the second promotional material receiving portion 14. The second front wall 46 is interconnected to the first front wall 30 by at least one or more of the second bottom 48, the third sidewall 42 and the fourth sidewall 44. In one variation, the second front wall 46 is interconnected to the first front wall 30 by all of the second bottom 48, and third and fourth sidewalls 42, 44. The second cavity 50 has an open top and is configured to receive promotional material 20 such as business cards. In one variation, the second bottom 48 is substantially horizontal relative to the flat surface on which the display device 10 is placed. In another variation, the second bottom 48 is substantially perpendicular with respect to the first front wall 30 and as a result angled with respect to the surface on which the device 10 is placed. Also in one variation, the second front wall 46 is substantially parallel with respect to the first front wall 30 and in another variation the second front wall 46 is substantially perpendicular with respect to the horizontal surface on which the device 10 is placed. Any combination of the above variations in one embodiment is within the scope of the present invention. Also, the upper edge of the second front wall 46 includes a scalloped or relieved portion 52 for easy finger access to the second cavity 50 and the promotional material 20 therein.

Figure 6:
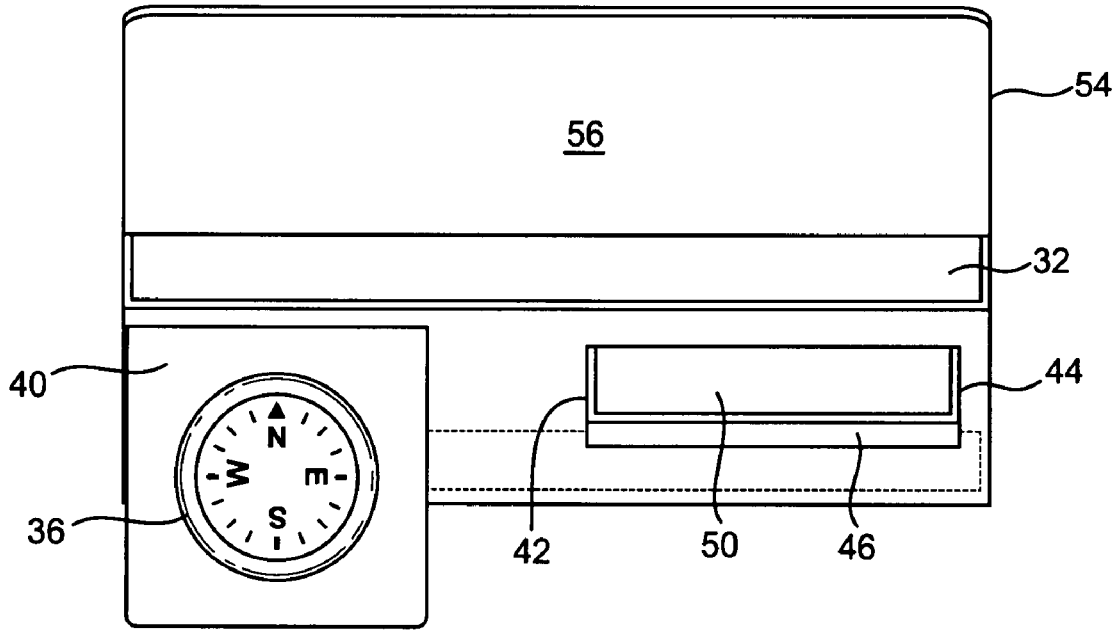
FIG. 6 is a top view of the promotional material display device according to the present invention.
Figure 7:
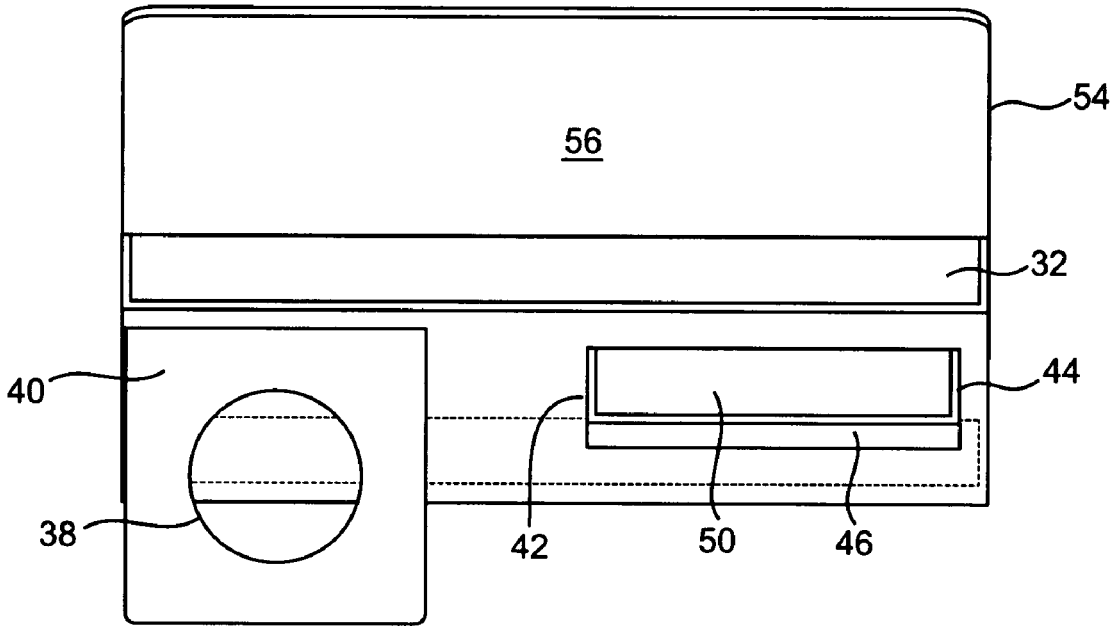
FIG. 7 is a top view of the promotional material display device according to the present invention without the direction indicator.

In one variation, the display device 10 includes a support 54 as visible in FIGS. 1, 6 and 7. The support 54 is connected to the first promotional material receiving portion 12 and is configured to support the first receiving portion 12 on a flat surface such that the first receiving portion 12 is angled with respect to the flat surface. In one variation, the support 54 includes a base wall 56 that is substantially parallel to the flat surface on which the device 10 is placed. The base wall 56 is generally connected to the first receiving portion 12 such that the base 56 forms an acute angle with the back wall 22. The base wall 56 is configured to support the device 10 on a flat surface in a substantially upright or slightly angled orientation as shown in the figures. In one variation, the base wall 56 is integral with the first bottom 28 and in another variation it is not. Of course, the display device 10 may be provided without a support and mounted on a wall. In such a variation, the support 54 would be configured for mounting the display device on a wall.

The preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are principally intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims.

We claim:

1. A promotional material display device comprising:

a first promotional material receiving portion configured to receive promotional material in a substantially upright orientation;

a support connected to the first promotional material receiving portion and configured to support the first promotional material receiving portion on a substantially horizontal surface; and a direction indicator connected to the device via a supporting surface; said supporting surface extending outwardly from an outer surface of the promotional material display device and configured to hold the direction indicator substantially parallel to the horizontal surface; the direction indicator being configured to provide indication of at least one direction information.

2. The device of claim 1 wherein the first promotional material receiving portion is sized to receive paper sized 8½ by 11 inches.

3. The device of claim 1 wherein the direction indicator is a compass.

4. The device of claim 1 further including a second promotional material receiving portion.

5. The device of claim 4 wherein the second promotional material receiving portion is sized to receive business cards.

6. The device of claim 4 wherein the second promotional material receiving portion is connected to and extends outwardly from the first promotional material receiving portion.

7. The device of claim 1 wherein the direction indicator is a representational compass.

8. The device of claim 1 wherein the at least one direction information is selected from the group consisting of north, south, east, west, sunny, dark, facing, sitting, city, airport, water, ocean, street, downtown and grocery store.

9. A promotional material display device comprising:

a back wall;

a first sidewall and a second sidewall; the first sidewall being spaced apart from the second sidewall;

a first front wall; the first front wall being spaced apart from the back wall;

a first bottom;

the back wall, the first and second sidewalls, the first front wall and the first bottom configured to define a first cavity of a first promotional material receiving portion; the first cavity having an open top such that the first front wall is interconnected to the back wall by at least one or more of the first bottom, the first sidewall and the second sidewall; the first cavity being configured to receive promotional material in a substantially upright orientation; and a direction indicator for indicating at least one direction information connected to the device; said direction indicator attached to a supporting surface; said supporting surface extending outwardly from an outer surface of the device and configured to hold the direction indicator substantially parallel to a substantially horizontal surface on which the device is placed.

10. The device of claim 9 wherein the first sidewall is substantially parallel to the second sidewall.

11. The device of claim 9 wherein the first front wall is substantially parallel to the backwall.

12. The device of claim 9 wherein the first front wall is interconnected to the backwall by the first and second sidewalls.

13. The device of claim 9 wherein the first front wall is interconnected to the back wall by the first bottom and the first and second sidewalls.

14. The device of claim 9 wherein the first front wall is shorter than the back wall such that the first front wall covers a portion of the back wall.

15. The device of claim 9 wherein the first bottom is configured to support the device on the horizontal surface such that the first cavity configured to receive promotional material is at an angle with respect to the horizontal surface.

16. The device of claim 9 wherein the first bottom is substantially perpendicular to the back wall.

17. The device of claim 9 further including a support connected to the device and configured to support the device on the substantially horizontal surface.

18. The device of claim 17 wherein the support is a base wall connected to the bottom of the device.

19. The device of claim 18 wherein the support is configured to support the device at an angle with respect to the horizontal surface such that the back wall forms an acute angle with respect to the base wall.

20. The device of claim 9 wherein the direction indicator is a compass.

21. The device of claim 9 wherein the direction indicator is a representational compass.

22. The device of claim 9 further including a direction indicator receiving portion.

23. The device of claim 22 wherein the direction indicator receiving portion includes a flange extending from the first front wall; the flange having an opening configured to receive a direction indicator.

24. The device of claim 9 further including a second promotional material receiving portion.

25. The device of claim 24 wherein the second promotional material receiving portion extends outwardly from the first front wall.

26. The device of claim 24 wherein the second promotional material receiving portion includes:

a third sidewall and a fourth sidewall; the third sidewall being spaced apart from the fourth sidewall;

a second front wall; the second front wall being spaced apart from the first front wall;

a second bottom;

the first front wall, the third and fourth sidewalls, the second front wall and the second bottom configured to define a second cavity of a second promotional material receiving portion; the second cavity having an open top such that the second front wall is interconnected to the first front wall by at least one or more of the second bottom, the third sidewall and the fourth sidewall; the second cavity being configured to receive promotional material.

27. The device of claim 26 wherein the second front wall is substantially parallel to the first front wall.

28. The device of claim 26 wherein the device is configured to be supported on a flat surface and the second bottom is substantially parallel to the horizontal surface.

29. The device of claim 26 wherein the device is configured to be supported on a horizontal surface and the second bottom is substantially perpendicular to the first front wall.

30. The device of claim 26 wherein the second front wall includes a relieved region formed in the upper edge to facilitate removal of promotional material from the second cavity.

31. The device of claim 9 wherein the back wall includes a relieved region formed in the upper edge to facilitate removal of promotional material from the first cavity.

32. The device of claim 9 wherein the device is made from a transparent material.

33. The device of claim 9 wherein the direction indicator indicates at least one compass direction.

34. A promotional material display device comprising:

a back wall;

a first sidewall and a second sidewall; the first sidewall being spaced apart from the second sidewall;

a first front wall; the first front wall being spaced apart from the back wall;

a first bottom;

the back wall, the first and second sidewalls, the first front wall and the first bottom configured to define a first cavity of a first promotional material receiving portion; the first cavity having an open top such that the first front wall is interconnected to the back wall by at least one or more of the first bottom, the first sidewall and the second sidewall; the first cavity being configured to receive promotional material; and a direction indicator for indicating at least one direction information connected to the device;

a direction indicator receiving portion;

wherein the direction indicator receiving portion includes a flange extending from the first front wall; the flange having an opening configured to receive a direction indicator; and wherein the device is configured to be supported on a flat surface and the flange is substantially parallel to the flat surface.

35. A promotional material holder for display on a substantially flat surface comprising:

a back wall;

a first sidewall and a second sidewall; the first sidewall being spaced apart from the second sidewall;

a first front wall; the first front wall being spaced apart from the back wall;

a first bottom;

the back wall, the first and second sidewalls, the first front wall and the first bottom configured to define a first cavity of a first promotional material receiving portion; the first front wall being interconnected to the back wall by the first bottom, the first sidewall and the second sidewall; the first cavity having an open top and being configured to receive promotional material in a substantially upright orientation;

a third sidewall and a fourth sidewall; the third sidewall being spaced apart from the fourth sidewall;

a second front wall; the second front wall being spaced apart from the first front wall;

a second bottom;

at least a portion of the first front wall, the third and fourth sidewalls, the second front wall and the second bottom configured to define a second cavity of a second promotional material receiving portion; the second front wall being interconnected to the first front wall by the second bottom, the third sidewall and the fourth sidewall; the first cavity having an open top and being configured to receive promotional material;

a base wall connected to the first promotional material receiving portion such that the base wall forms an acute angle with the back wall; the base wall being configured to support the device on the flat surface; and a direction indicator for indicating at least one direction information; said direction indicator attached to a supporting surface connected to the device; said supporting surface extending outwardly from one of said walls and configured to hold the direction indicator substantially parallel to a horizontal surface on which the device is placed.

* * * * *